United States Patent [19]

Nickolay et al.

[11] Patent Number: 4,763,467

[45] Date of Patent: Aug. 16, 1988

[54] METHOD AND MEANS OF CONTROLLING THE STOP OF THE FEED OF ROVING IN A SPINNING MACHINE

[75] Inventors: Helmut Nickolay, Goppingen; Wolfgang Igel, Ebersbach/Fils; Werner Meissner, Hattenhofen; Richard Schollhammer, Goppingen, all of Fed. Rep. of Germany

[73] Assignee: Zinser Textilmaschinen GmbH, Fed. Rep. of Germany

[21] Appl. No.: 920,032

[22] Filed: Oct. 16, 1986

[30] Foreign Application Priority Data

Oct. 16, 1985 [DE] Fed. Rep. of Germany ..... 3536913

[51] Int. Cl.[4] ..... D01H 13/18; D01H 15/00

[52] U.S. Cl. ..... 57/261; 57/86

[58] Field of Search ..... 57/261, 262, 263, 264, 57/81, 83, 86

[56] References Cited

U.S. PATENT DOCUMENTS

| | | | |
|---|---|---|---|
| 3,636,695 | 1/1972 | Ingham | 57/68 X |
| 3,688,486 | 9/1972 | Bell et al. | 57/262 |
| 3,726,072 | 4/1973 | Ford et al. | 57/83 X |
| 3,740,937 | 6/1973 | Drake | 57/81 X |
| 4,023,341 | 5/1977 | Saino et al. | 57/81 |
| 4,178,749 | 12/1979 | Stahlecker et al. | 57/263 |
| 4,501,114 | 2/1985 | von Ronai-Horvath et al. | 57/81 |
| 4,660,365 | 4/1987 | Raasch | 57/263 |

*Primary Examiner*—Stuart S. Levy
*Assistant Examiner*—Joseph J. Hail, III
*Attorney, Agent, or Firm*—Shefte, Pinckney & Sawyer

[57] ABSTRACT

Controlling the stop of the feed of roving in a spinning machine in which yarn is wound on spindles through travelers rotating on rings and in which a stop motion is actuated to stop the feed of the roving to drafting rolls in response to detecting a yarn break and is subsequently deactuated to permit roving feed during a yarn break repair operation. The stop motion includes an arcuate stop member rotatably mounted on one of the drafting rolls for rotation into disposition between opposing rolls to separate the rolls and stop roving feed, with the stop member having a projecting cam engaging in a recess in a slide member that is manipulated by a spring and electromagnetic device to control manipulation of the stop member. Response of the stop motion to the detection of a yarn break is deactivated upon initiation of a yarn break repair operation and is maintained until the detection indicates that spinning has resumed for a predetermined length of time sufficient to indicate that the yarn break has been repaired, with the deactivating continuing in the event a yarn break has not been successfully repaired. The repair operation is repeated until successful or for a selected number of unsuccessful attempts, at which time a false simulation of resumption of spinning is given to reactivate response of the stop motion to the yarn break detection for deactuating the stop motion and to stop roving feed. Device for sensing whether a yarn break has been successfully repaired and the device for providing a false simulation are incorporated in an electronic circuit on the yarn break repair device, which circuit is connected through an optical transmission device to an electronic circuit on the spinning machine that includes the stop motion deactivating device.

20 Claims, 2 Drawing Sheets

S 52

DT
1
0
t
T1
T2
T3
T5
T4
T60
T61
T62
T7
T9
S54
DT
1

0
t
T8
T9
T7
S55
1

0
t
T1
T5
T9

METHOD AND MEANS OF CONTROLLING THE STOP OF THE FEED OF ROVING IN A SPINNING MACHINE

BACKGROUND OF THE INVENTION

The present invention relates to a method of controlling the stop of the feed of roving in a spinning machine, and more particularly to such method and means that provides for deactuating the stop motion means to permit roving feed during operation of a yarn break repair means after the stop motion means has been actuated to stop the feed of roving to the drafting rolls upon detection of a yarn break.

Stop motions are commonly used commercially in textile spinning machines in conjunction with yarn break detectors to stop the feed of roving to the drafting rolls of the machine upon the occurrence of a yarn break. To repair a yarn break the stop motion is then deactuated by the operator, who repairs the break and reactuates the stop motion for subsequent operation when the next yarn break occurs.

By the present invention the stop motion actuation and deactuation functions are automatically performed and controlled without attention by the operator unless a sequence of yarn break repair operations have been unsuccessful.

SUMMARY OF THE INVENTION

Briefly described, the method and means of the present invention for controlling the stop of the feed of roving in a spinning machine includes means for deactivating the response of stop motion means to yarn break detecting means subsequent to an actuation of the stop motion means to stop roving feed in response to a previous detection of a yarn break. This deactivation permits roving feed upon initiation of operation of a yarn break repair means, with the deactivation being maintained until the detecting means has detected that spinning has been resumed for a predetermined length of time sufficient to indicate that the yarn break has been repaired, with the deactivating continuing in the event a yarn break has not been successfully repaired.

Preferably the yarn break repair operation is repeated until successful or until a predetermined number of unsuccessful operations have been performed after which a false simulation of resumption of spinning is signaled to reactivate response of the stop motion to the yarn break detecting means and cause roving stop actuation thereof.

In the preferred embodiment the yarn break detecting means in an inducation sensor disposed adjacent the ring associated with the spinning spindle, with the sensor detecting the absence of rotation of the traveler on the ring and being connected to stop motion means through means for deactivating the stop motion means. The stop motion deactivating means is included in an electronic logic circuit on the spinning machine. Means are provided for sensing whether a yarn break has not been repaired, in response to which the repair operation is repeated. The repair sensing means and the false simulation means are in an electronic circuit incorporated in the yarn break repair means with the circuit being coupled with the aforementioned circuit for the stop motion deactivating through an optical transmission means.

The stop motion means is preferably in the form of an arcuate stop member that is disposed about a portion of a driven drafting roll and is movable into a disposition between the opposing rolls with the roving between the stop member and the opposite idler roll, causing a stop of the roving feed. A releasable retaining means is provided in the form of a slide member for retaining the stop member against movement into feed stopping disposition. For this purpose the stop member is formed with a projecting cam received in a recess in the slide member for manipulation upon sliding of the slide member to manipulate the stop member into feed stopping disposition. An electromagnetic releasing means is connected to the slide member and is actuated upon detection of a yarn break to manipulate the stop member. Movement of the slide member is controlled by a spring means that normally urges the slide member into a stop member manipulating disposition, which is prevented by an electromagnetic means having an operating rod normally engaged in a depression in the slide member to retain the slide member in stop member retaining disposition, and which is movable out of the depression upon actuation of the electromagnetic means to manipulate the slide member for movement of the stop member into feed stopping disposition.

Other features and advantages of the present invention shall be apparent from the following detailed description of the preferred embodiment and from the accompanying drawings.

DETAILED DESCRIPTION OF THE PREFERRED EMBODIMENT

Figure 1:
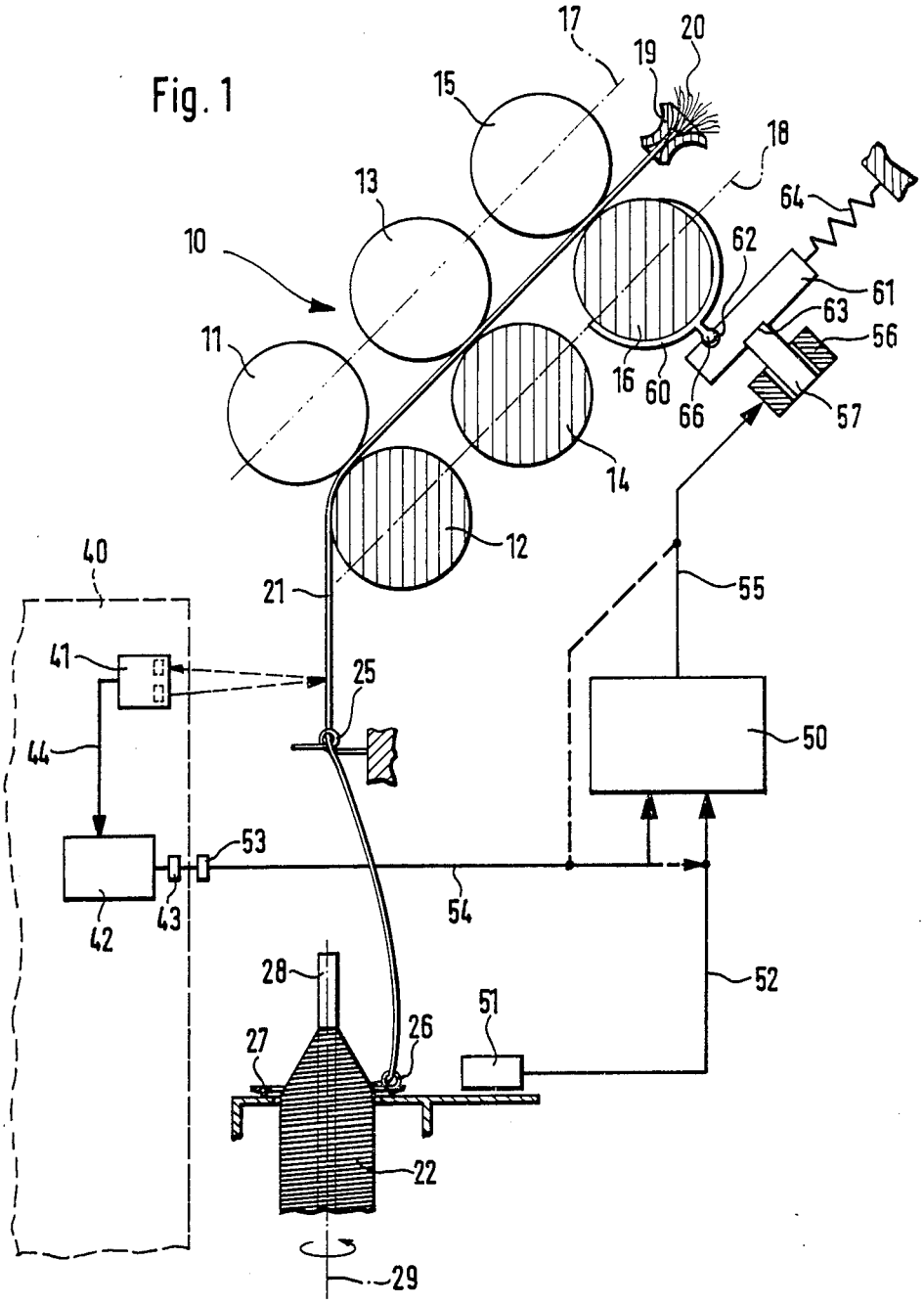
FIG. 1 is a schematic side elevation of a portion of a spinning machine incorporating the method and means of controlling the stop of the feed of roving in a spinning machine of the present invention.

Referring to the drawings, a drafting system 10 at one spinning station of a textile ring spinning machine is illustrated in FIG. 1 having three aligned pairs of rolls 11 and 12, 13 and 14, and 15 and 16 with the upper rolls 11,13 and 15 of each pair being idler rolls arranged with their axes in a common plane 17 and the other rolls 12,14 and 16 of each pair being driven rolls arranged with their axes in a common plane 18. The idler rolls 11,13 and 15 are yieldably for movement toward and away from the driven rolls 12,14 and 15 to permit variation in spacing during operation. The rolls in each pair are rotated at the identical speed, but the speeds of the pairs increase from the first roll pair 15,16 to the last roll pair 11,12.

Roving 20 is fed from a source through an inlet funnel 19 to the roll pairs, with the increasing speed of the roll pairs in the running direction of the roving causing the roving to be drawn into a yarn 21 exiting the last roll pair 11,12 at a thickness of the final yarn, but not yet twisted. Twisting of the yarn 21 is achieved by winding it onto a rotating spindle 28 to which it is guided through a yarn guide eyelet 25 and traveler 26 that rotates on the spindle ring 27 with the yarn 21 rotating with the traveler 26 on the ring 27 as the spindle 28 rotates. The resulting spun yarn twisted in this manner and would on the spindle 28 is indicated by the reference numeral 22 in FIG. 1.

Stop motion means actuatable to stop the feed of roving to the drafting rolls in response to detection of a yarn break by detecting means is provided in the form of an arcuate stop member 60 disposed about a portion of the driven roll 16 of the first pair of drafting rolls and is movable to insert its leading tapered end between the opposing rolls 15,16 under the roving to stop rotation of the idler roll and feed of the roving. The arrangement, design and method of operation of the stop member 60 are known and do not require further explanation herein.

Releasable retaining means in the form of a slide 61 retains the arcuate stop member 60 against movement into stopping disposition. The slide 61 is connected to an electromagnetic releasing means 56,57 that is actuated in response to detection of a yarn break to slide under the influence of a spring 64 to manipulate the arcuate stop member 60 into feed stopping disposition. This is accomplished by a projecting cam 66 on the stop member 60 received in a recess 62 in the slide member 61, with the spring 64 connected to the slide member 61 for normally urging the slide member into stop member manipulating disposition. The electromagnetic means has an operating rod 57 normally engaged in a depression 63 in the slide member 61 on the opposite side to the recess 62 therein to retain the slide member in stop member retaining disposition. The operating rod 57 is a magnetic element within an electromagnetic coil 56, which upon energization in response to a yarn break withdraws the rod 57 from the slide depression 63 to allow the slide to manipulate the stop member 60 into stopping disposition. The slide 61 is reset with the rod 57 engaged in the depression 63 by a force counter to the action of the spring 64, which force can be supplied either by an operator manually or by an automatic device (not shown).

The yarn break detection means in the form of an inductive sensor 51 mounted on the ring rail adjacent the path of the traveler 26 and is connected by an electrical lead line 52 to a control device 50. Upon rotation of the traveler 26 on the ring 27 in winding of yarn onto the spindle 28, the inductive sensor 51 indicates this condition through the electrical lead line 52 to the control device 50, which does not then send an energizing signal to the coil 56. On the other hand, when the traveler 26 is not rotating, which indicates that a yarn break has occurred, the inductive sensor 51 will send an indication of this condition through electrical lead line 52 to control device 50, which then normally energizes the coil 56 through electrical lead line 55 to cause withdrawal of the magnetic rod 57 from the depression 63 of the slide 61, thereby manipulating the stop member 60 into feed stopping disposition.

A yarn break repair means 40, such as a yarn piecing unit, is partially illustrated within the dash lines at the left center of FIG. 1. This unit serves to automatically repair yarn breaks and for this purpose it travels along the spinning machine for stopping at spindles at which a yarn has broken. In stopped position it is located adjacent the spindle 28 and generally parallel to the direction of the yarn 21. An optical yarn break repair sensor 41 is carried by the piecing unit 40 to detect a yarn break at a spindle by sensing the reflection of a light beam that indicates the presence of a yarn 21 and also indicates that a yarn break has not been successfully repaired. This sensor 41 is connected through an electrical lead line 44 to an electronic logic circuit 42 in the form of an electronic microprocessor, which controls the various devices for repairing a yarn break and operates in response to the repair sensor 41 to cause repeating of the yarn break repair operation when the sensor 41 indicates that a repair operation has not been successful.

The optical transmitter 43 emits signals that are received by an optical receiver 53 mounted on the spinning machine at the spindle station and which directs the signals through electrical lead line 54 to the control device 50. The optical receiver 53 may be in the form of a diode that is activated by a light beam exposed by a pivoted plate in response to the logic element 42. However, other optical or inductive transmission elements can also be used for this purpose. An optical transmission device has the advantage that it can be interrupted manually by an operator for manual attempts to eliminate a thread break as well as being automatically operated by the piecing unit.

When the yarn break repair or piecing unit is about to initiate a repair or piecing operation, it signals the control device 50, which deactivates response of the stop member to the inductive sensor 51 so that the stop member is deactivated and roving feed is resumed. This deactivation is maintained by the control device 50 until the inductive sensor 51 has detected that spinning has been resumed for a predetermined length of time sufficient to indicate that the yarn break has been repaired, with the deactivating continuing in the event a yarn break has not been successfully repaired.

The repair or piecing is sequentially repeated until a yarn break is successfully repaired, which is signaled from the yarn break repair sensor 41 to the control device 50 to cease the deactivating of the stop motion and reactuate the response of the stop motion to the inductive sensor 51. As the inductive sensor is detecting the presence of a yarn after the yarn break has been repaired, the responsive stop motion remains out of feed stopping disposition until the occurrence of the next yarn break.

The microprocessor 42 is programmed so that if repair or piecing is not successful after a selected number, such as three, of sequential operations, further operation will be discontinued and a signal will be sent from the microprocessor 42 through the optical transmission means 53,53 and lead line 54 to the control device, which signal falsely simulates a detection of resumption of spinning for a length of time at least as long as the aforementioned predetermined time sufficient to indicate that a yarn break has been successfully repaired. The control device then responds to terminate the deactivation of the stop motion and allows it to be actuated into roving feed stop disposition in response to the real sensing of the absence of spinning by the inductive sensor 51. Alternatively to being connected to the control device 51, the false signal can be fed directly to the lead line 55 to the coil 56 or to the lead line 52 from the inductive sensor 51 to the control device 50. These alternatives are indicated by broken lines in FIG. 1.

After a yarn break has been successfully repaired or the unsuccessful repair operations discontinued, the yarn break repair or piecing unit 40 resume its travel along the spinning machine until it responds to a yarn break at another spinning station.

Figures 2, 3, 4:
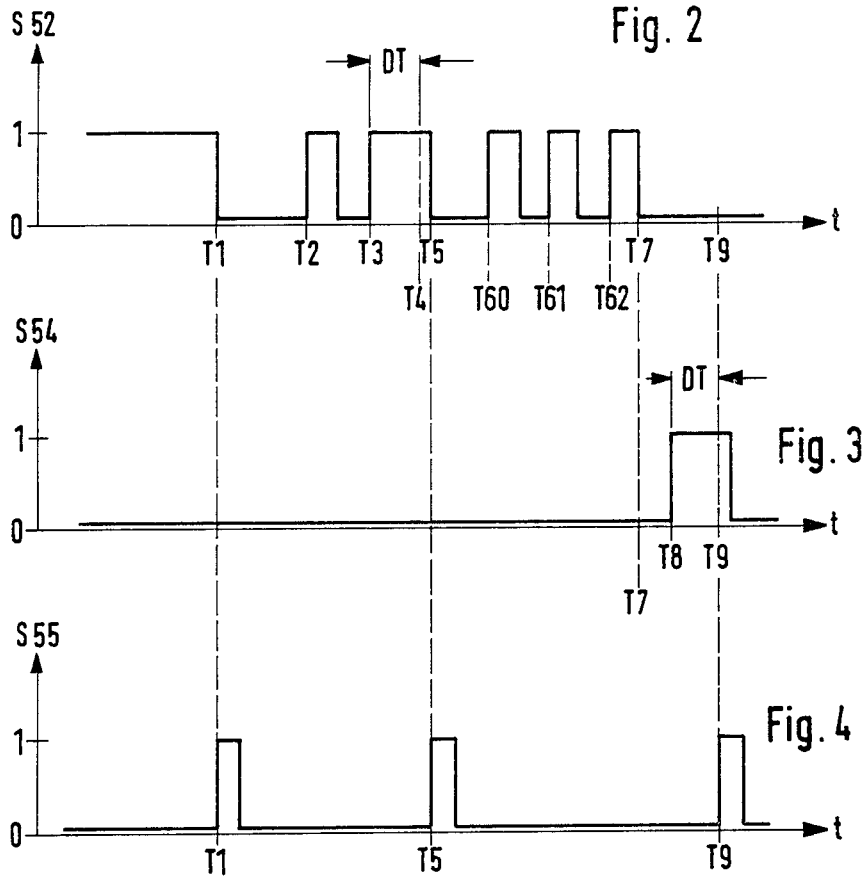
FIGS. 2–4 are timing diagrams of the operation of the method and means of the present invention illustrated in FIG. 1.

Referring to the timing diagrams of FIGS. 2, 3 and 4, the signals on the electric lead lines 52,54 and 55 are schematically illustrated. The signal on lead line 52 is designated in FIG. 2 by the reference S52, the signal on lead line 54 is designated in FIG. 3 by reference S54 and the signal of lead line 55 is designated in FIG. 5 by reference S55, the magnitude of these signals is indicated on the ordinate of the timing diagrams and the time t is represented on the abscissa. Each of the signals has two states, designated on the timing diagrams by "0" and "1". When S52 equals 1, it indicates that the inductive sensor 51 is detecting the presence of a yarn at the traveler 26, and when it is equal to 0, the inductive sensor 51 is indicating that there is no yarn present at the traveler 26 and, therefore, a yarn break has occurred. When S54 is equal to 1, it is providing a signal falsely simulating a resumption of spinning. When S55 equals 1 the stop motion is actuated by energization of the magnetic coil 56 in response to the signal S52 to move to roving feed stopping disposition, and when S55 equals 0 the stop motion response is deactivated and the stop motion is disposed out of roving feed stopping position.

Referring to FIG. 2, a yarn break is indicated as having occurred at time T1, which causes energization of the magnetic coil 56 by the control device 50 as indicated in FIG. 4, causing the stop member 60 to move into feed stopping position. At time T2 the the piecing unit 40 has moved into place and the microprocessor has signaled the control device 50 to deactivate the stop member 60 and allow roving to feed. The piecing unit 40 then performs an unsuccessful piecing operation which results in a sensing by the inductive sensor 51 for a length of time less than a predetermined minimum time DT required to terminate the deactivating of the response of the stop motion to the sensor so that the stop motion continues deactuated. This attempt at piecing is sensed by repair sensor 41 to be unsuccessful and a second attempt is indicated to begin at time T3, resulting in a successful piecing at time T4 with a detection of spinning by said inductive sensor 51 for a length of time DT so that the deactivating of the stop motion is discontinued and the stop motion is again responsive to the yarn break sensing. Spinning continues until a yarn break occurs at time T5 at which signal S55 actuates the stop motion in response to yarn break detection by the inductive sensor 51 to stop roving feed. When the piecing unit 40 arrives at the station and senses the yarn break, it deactivates the stop motion and makes three unsuccessful attempts to piece the yarn at times T60,T61 and T62, none of which result in spinning for the predetermined length of time DT such that the stop motion remains deactivated during these attempts.

After the third unsuccessful attempt is terminated at time T7, the microprocessor emits a signal beginning at time T8 falsely simulating the detection of spinning and maintains the signal for a length of time longer than the predetermined length of time DT (indicated from T8 to T9 in FIG. 3) so that the control device 50 discontinues the deactivation of the stop motion, which again becomes responsive at time T9 to the yarn break sensing by the inductive sensor 51 to move into roving feed stopping disposition, in which it remains until an operator repairs the yarn break or the problem causing the inability of the yarn break to be repaired.

It is particularly advantageous to use an electronic calculator as the control device 50 and an electronic circuit as the logic element 42. This makes the control of the stop motion arrangement electronic, which is obviously more effective than a mechanical design.

The present invention is not limited to the arrangement at a single spinning station as described in relation to FIG. 1, but is applicable to all spinning stations in a ring spinning machine, wherein it is advantageous to have a traveling yarn break repair means or piecing unit that patrols the spinning stations and stops at a station in which a yarn break has been sensed and then resumes when the break has been repaired or pieced or if a selected number of sequential unsuccessful attempts has been peformed.

If desired, a single optical transmission means may be associated with several spinning stations for simplicity, which arrangement does not result in undesirable actuation of the stop motion means or the repair or piecing operation as signal S52 will continuously remain equal to 1 at the spinning stations at which no thread break is present and there will, therefore, be no feed stopping action, while at the spinning station in which signal S52 equals 0 the stop member 60 will already have been manipulated into roving stop position in readiness for a repair or piecing operation.

The drafting system 10 may correspond to that disclosed in German Pat. No. DE-OS 34 04 291, which includes upper aprons and lower aprons for the intermediate roll pairs 13,14. A stop member 16 can also be provided for the roll 14 of the intermediate pair with a similar manipulating mechanism utilizing an appropriately lengthened slide 61.

It will therefore be readily understood by those persons skilled in the art that the present invention is susceptible of a broad utility and application. Many embodiments and adaptions of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptions, variations, modifications and equivalent arrangements, the present invention being limited only by the claims appended hereto and the equivalents thereof.

We claim:

1. A method of controlling the stop of the feed of roving in a spinning machine in which a stop motion means is actuated to stop the feed of roving to drafting rolls in response to detecting means detecting a yarn break and is subsequently deactuated to permit roving feed during operation of yarn break repair means, said method comprising, following said detecting means detecting a yarn break and actuating said stop motion means for stopping roving feed, deactivating the response of said stop motion means to said yarn break detecting means to thereby deactuate said stop motion means permitting roving feed to resume in advance of yarn break repair, then operating said yarn break repair means to perform a yarn break repair operation while said stop motion means is deactuated, maintaining said deactivating until said detecting means has detected that spinning has been resumed for a predetermined length of time sufficient to indicate that the yarn break has been repaired, with the deactivating continuing uninterrupted in the event a yarn break has not been successfully repaired.

2. A method of controlling the stop of the feed of roving in a spinning machine according to claim 1 and characterized further by sensing whether a yarn break has been successfully repaired, and repeating operating of said yarn break repair means to perform a subsequent repair operation upon sensing that a yarn break had not been successfully repaired.

3. A method of controlling the stop of the feed of roving in a spinning machine according to claim 2 and characterized further by sequential repeating of said yarn break repair operation until a successful yarn break repair has been performed.

4. A method of controlling the stop of the feed of roving in a spinning machine according to claim 3 and characterized further by discontinuing said sequential repeating upon repeating for a selected number of times without a successful yarn break repair having been performed, and thereafter reactivating the response of said stop motion means to said yarn break detecting means to thereby activate said stop motion means to stop roving feed in response to the yarn break being detected by the detecting means.

5. A method of controlling the stop of the feed of roving in a spinning machine according to claim 4 and characterized further in that said reactivating is performed by falsely simulating a detection of resumption of spinning for a legnth of time at least as long as said predetermined time.

6. A method of controlling the stop of the feed of roving in a spinning machine according to claim 5 and characterized further in that said falsely simulating a detection is performed by said yarn break repair means.

7. A method of controlling the stop of the feed of roving in a spinning machine according to claim 4 and characterized further in that said sensing whether a yarn break has been successfully repaired and said discontinuing after a selected number of sequential repeatings is performed by said yarn break repair means.

8. A method of controlling the stop of the feed of roving in a spinning machine according to claim 2 and characterized further in that said sensing whether a yarn break has been successfully repaired is performed by said yarn break repair means.

9. Means for controlling the stop of the feed of roving in a spinning machine wherein the machine includes stop motion means actuatable to stop the feed of roving to drafting rolls in response to detecting means detecting a yarn break and deactuatable to permit roving feed during operation of yarn break repair means, said controlling means comprising means for deactivating the response of said stop motion means to said yarn break detecting means following deactuation by said detecting means of a yarn break and actuation of said stop motion means by said detecting means to thereby deactuate said stop motion means to permit roving feed to resume during operation of said yarn break repair means, said deactivating means maintaining deactuation of said stop motions means until said detecting means has detected that spinning has been resumed for a predetermined length of time sufficient to indicate that the yarn break has been successfully repaired, with said deactivating means continuing the deactivation of said stop motion means uninterrupted in the event a yarn break has not been successfully repaired.

10. Means for controlling the stop of the feed of roving in a spinning machine according to claim 9 and characterized further by means for sensing whether a yarn break has not been successfully repaired, and in that said yarn break repair means is operable to repeat a yarn break repair operation in response to said sensing means sensing that a yarn break has not been successfully repaired.

11. Means for controlling the stop of the feed of roving in a spinning machine according to claim 10 and characterized further in that said yarn break repair means in operable to repeat said yarn break repair operation a selected number of times in the event a yarn break is not successfully repaired.

12. Means for controlling the stop of the feed of roving in a spinning machine according to claim 11 and characterized further in that said yarn break repair means includes means operable after said selected number of operations to provide a false simulation that spinning has been resumed for a length of time at least as long as said predetermined time, thereby actuating response of said stop motion means to said yarn break detecting means to stop roving feed.

13. Means for controlling the stop of the feed of roving in a spinning machine according to claim 12 and characterized further in that said false simulation means is incorporated in said yarn break repair means.

14. Means for controlling the stop of the feed of roving in as spinning machine according to claim 12 and characterized further by optical transmission means for coupling said false simulation means with said deactivating means.

15. Means for controlling the stop of the feed of roving in a spinning machine according to claim 12 and characterized further in that said means for sensing whether a yarn break has been successfully repaired and said false simulation means are in a electronic circuit incorporated in said yarn break repair means.

16. Means for controlling the stop of the feed of roving in a spinning machine according to claim 10 and characterized further in that said means for sensing whether a yarn break has been successfully repaired is incorporated in said yarn break repair means.

17. Means for controlling the stop of the feed of roving in a spinning machine according to claim 9 and characterized further in that said deactivating means is in an electronic circuit.

18. Means for controlling the stop of the feed of roving in a spinning machine according to claim 9 wherein the spinning machine includes a spindle on which yarn is wound through a traveler rotating on a ring and characterized further in that said yarn break detecting means comprises an inductive sensor disposed adjacent said ring for detection of the absence of rotation of said traveler and connected through said stop motion deactivating means to said stop motion means.

19. Means for controlling the stop of the feed of roving in a spinning machine according to claim 9 and in which one of the drafting rolls is driven and an opposed roll is an idler roll, said controlling means being characterized further in that said stop motion means comprises an arcuate stop member disposed about a portion of the driven roll and movable into a disposition between opposing rolls with the roving between said stop member and the opposite idler roll to stop roving feed, releasable retaining means retaining said arcuate stop member against movement into feed stopping disposition, and electromagnetic releasing means connected to said retaining means and actuated upon said detecting means detecting a yarn break to release said retaining means to cause said arcuate stop member to move into feed stopping disposition.

20. Means for controlling the stop of the feed of roving in a spinning machine according to claim 19 and characterized further in that said arcuate stop member has a projecting cam formed thereon, said retaining means comprises a slide member having a recess for receiving said cam and being slidable to manipulate said cam for movement of said stop member into feed stopping disposition, spring means connected to said slide member for normally urging said slide member into stop member stopping disposition, and said electromagnetic means has an operating rod normally engaged in a depression in said slide member to retain said slide member in stop member retaining disposition and is movable out of said depression upon actuation of said electromagnetic means to release said slide member for movement of said stop member into feed stopping disposition.

* * * * *